United States Patent [19]

Seleno

[11] Patent Number: 4,633,845

[45] Date of Patent: Jan. 6, 1987

[54] VACUUM CONTROL DEVICE

[75] Inventor: Frank M. Seleno, Haslett, Mich.

[73] Assignee: Schmelzer Corporation, Flint, Mich.

[21] Appl. No.: 646,201

[22] Filed: Aug. 31, 1984

[51] Int. Cl.[4] ..... F02M 25/06

[52] U.S. Cl. ..... 123/568; 137/907; 251/28; 251/61.5

[58] Field of Search ..... 123/568, 569, 587; 137/DIG. 8; 251/28, 61.5

[56] References Cited

U.S. PATENT DOCUMENTS

| | | | |
|---|---|---|---|
| 2,169,683 | 8/1939 | Dunham et al. | 137/DIG. 8 |
| 2,650,581 | 9/1953 | Short et al. | 123/409 |
| 2,715,418 | 8/1955 | Van Derbeck | 137/510 |
| 3,411,522 | 11/1968 | Golden et al. | 137/DIG. 8 |
| 3,616,783 | 11/1971 | La Masters | 123/519 |
| 3,739,797 | 6/1973 | Caldwell | 123/568 X |
| 3,756,210 | 9/1973 | Kuehl | 123/568 |
| 3,861,642 | 1/1975 | Maddocks | 123/568 X |
| 3,935,850 | 2/1976 | King | 123/520 |
| 3,996,955 | 12/1976 | Kawabata | 123/409 X |
| 4,041,914 | 8/1977 | Sugihara et al. | 123/568 |
| 4,044,743 | 8/1977 | Eaton | 251/61.1 |
| 4,089,349 | 5/1978 | Schenk | 137/859 |
| 4,130,267 | 12/1978 | Inada | 123/585 X |
| 4,151,819 | 5/1979 | Inada | 123/568 |
| 4,166,476 | 9/1979 | Yamanaka et al. | 137/DIG. 8 |
| 4,180,377 | 12/1979 | Itakura | 137/855 |
| 4,182,291 | 1/1980 | Ito | 123/339 |
| 4,198,937 | 4/1980 | Suzuki | 123/409 |
| 4,217,969 | 8/1980 | Riddel | 123/319 X |
| 4,218,040 | 8/1980 | Brakebill | 251/28 |
| 4,254,938 | 3/1981 | Inada et al. | 137/DIG. 8 |
| 4,327,773 | 5/1982 | Detweiler | 137/DIG. 8 |
| 4,377,146 | 3/1983 | Oniki et al. | 123/520 |
| 4,411,603 | 10/1983 | Kell | 137/855 |

FOREIGN PATENT DOCUMENTS

| | | | |
|---|---|---|---|
| 2421320 | 3/1979 | France | 137/DIG. 8 |

*Primary Examiner*—Willis R. Wolfe, Jr.

*Attorney, Agent, or Firm*—Harness, Dickey & Pierce

[57] ABSTRACT

A device for selectively modifying the vacuum level provided by a variable vacuum source is described, which generally includes a housing having two inlet ports and an outlet port. The first inlet port provides communication between the housing and the vacuum source. The second inlet provides communication between the housing and the atmosphere. The outlet port provides communication between the housing and a vacuum responsive device. A first valve assembly is contained in the housing for controlling the communication between the first inlet port and a control chamber in the housing, such that the maximum vacuum level reached by the vacuum source beyond a predeterminable vacuum level is maintained in the control chamber. A passageway is formed in the housing for providing communication between the control chamber and the outlet port. A second valve assembly in the housing is responsive to the vacuum level in the control chamber for permitting a predeterminable controlled communication between the second inlet port and the outlet port over a predeterminable vacuum level range.

18 Claims, 7 Drawing Figures

VACUUM CONTROL DEVICE

BACKGROUND AND SUMMARY OF THE INVENTION

The present invention relates generally to vacuum controlling devices and particularly to a device for selectively modifying the vacuum level provided by a variable vacuum source.

Various vacuum responsive devices are used in the fuel or emission systems of internal combustion engines. A common source of vacuum for these devices is the intake manifold of the engine. However, the vacuum created in the engine intake manifold varies significantly with the operation of the engine. Thus, for example, the vacuum in the engine intake manifold becomes minimal or non-existent whenever the engine is given full throttle.

Since the vacuum level required by a vacuum responsive device under certain engine operating conditions may be different than the vacuum level provided by the engine intake manifold, it is desirable to provide an interface between the intake manifold and the vacuum responsive device which is capable of working with the variable intake manifold vacuum to more accurately meet the vacuum level needs of the vacuum responsive device. Preferably, such an interface would take the form of a device which does not require any external energy input and which is inexpensive to manufacture. Additionally, it would be advantageous for this device to be of such a design which permits easy modification in order to be useful in a variety of applications.

Such a device would find particular application in fuel systems which employ an exhaust gas recirculation valve (EGR). As well known in the art, an EGR valve is used to recirculate a portion of the exhaust gases back into the intake manifold of the engine as a way of reducing undesirable exhaust emissions from the engine. Since EGR valves typically operate in response to an applied vacuum, the vacuum in the intake manifold provides a convenient source of vacuum for the EGR valve. However, there are times in which the vacuum generated in the intake manifold does not match the vacuum required by the EGR valve for optimum engine operation. For example, upon the starting of the engine, the vacuum in the intake manifold may quickly become effective to open the EGR valve, even though it may be more advantageous to prevent any exhaust gas recirculation at this time. Additionally, under certain steady state engine operating conditions, the vacuum level in the intake manifold may become insufficient to maintain a desirable opening of the EGR valve.

Furthermore, it is possible for the vacuum level in the intake manifold to fluctuate around the point at which the EGR valve opens. This may result in an undesirable fluttering of the EGR valve. Accordingly, it would be desirable to bypass the critical actuation point of the EGR valve, so that the EGR positively opens and closes only when it is desirable to do so.

While a variety of valve assemblies have been used in the past as interfaces between the engine intake manifold and an EGR valve, such valve assemblies have generally been very complex, and hence costly and not readily susceptible to modifications which would be necessary for use in different applications. These are particularly important considerations in the automobile industry where cost effectiveness and design simplicity are very desirable advantages, especially when a device must be able to respond to several different operating conditions. Thus, for example, the number of components used in a particular design and the number of steps to assemble those components are significant design aspects to suppliers in the automobile industry.

It is therefore a principal objective of the present invention to provide a device which is capable of selectively modifying the vacuum level provided by a variable vacuum source, such as an intake manifold.

It is another objective of the present invention to provide a device which is capable of both maintaining a full vacuum under certain engine operating conditions and reducing the vacuum level under other engine operating conditions.

It is an additional objective of the present invention to provide a device which is capable of being "programmed" to produce a variety of desired vacuum level modifications.

It is a further objective of the present invention to provide a device which is capable of more accurately matching the vacuum level requirements of a vacuum responsive device to a variable vacuum source.

It is yet another objective of the present invention to provide a single self-contained device which can be used to interface an EGR valve to an engine intake manifold, and yet which is also inexpensive to manufacture and assemble.

It is yet an additional objective of the present invention to provide a device which can dampen changes in the intake manifold vacuum level where desirable, and insulate the EGR valve from other changes in the intake manifold vacuum level.

Accordingly, to achieve the foregoing objectives, the present invention provides a device for selectively modifying the vacuum level provided by a variable vacuum source, which generally includes a housing having two inlet ports and an outlet port. The first inlet port is used to provide communication between the housing and the vacuum source, while the second inlet is used to provide communication between the housing and the atmosphere. The outlet port is used to provide communication between the housing and a vacuum responsive device. The device also includes a first valve assembly which is contained in the housing for controlling the communication between the first inlet port and a control chamber in the housing, such that the maximum vacuum level reached by the vacuum source beyond a predeterminable vacuum level is maintained in the control chamber. A passageway is also formed in the housing for providing communication between the control chamber and the outlet port. Additionally, the device includes a second valve assembly in the housing which is responsive to the vacuum level in the control chamber for permitting a predeterminable controlled communication between the second inlet port and the outlet port over a predeterminable vacuum level range.

As will be more fully appreciated from the description below, the first and second valve assemblies cooperate to, in essence, trick the vacuum responsive device into seeing a vacuum level which is at times predeterminably different than the vacuum level currently provided by vacuum source, during both increases and decreases in the vacuum level provided by the vacuum source. Additionally, both the first and second valve assemblies can be readily modified to provide a variety of linear and non-linear functional relationships between the vacuum level provided by the vacuum source and the vacuum level produced at the output port of the device. Importantly, even though the device is capable of providing complex functional relationships between its input and output vacuum levels, it is nevertheless comprised of relatively few components which are easy to assemble. Furthermore, the design of this device also permits the incorporation of the device in an EGR valve to provide a single structure.

Additional advantages and features of the present invention will become apparent from a reading of the detailed description of the preferred embodiments which makes reference to the following set of drawings in which:

DETAILED DESCRIPTION OF THE PREFERRED EMBODIMENTS

Figure 1:
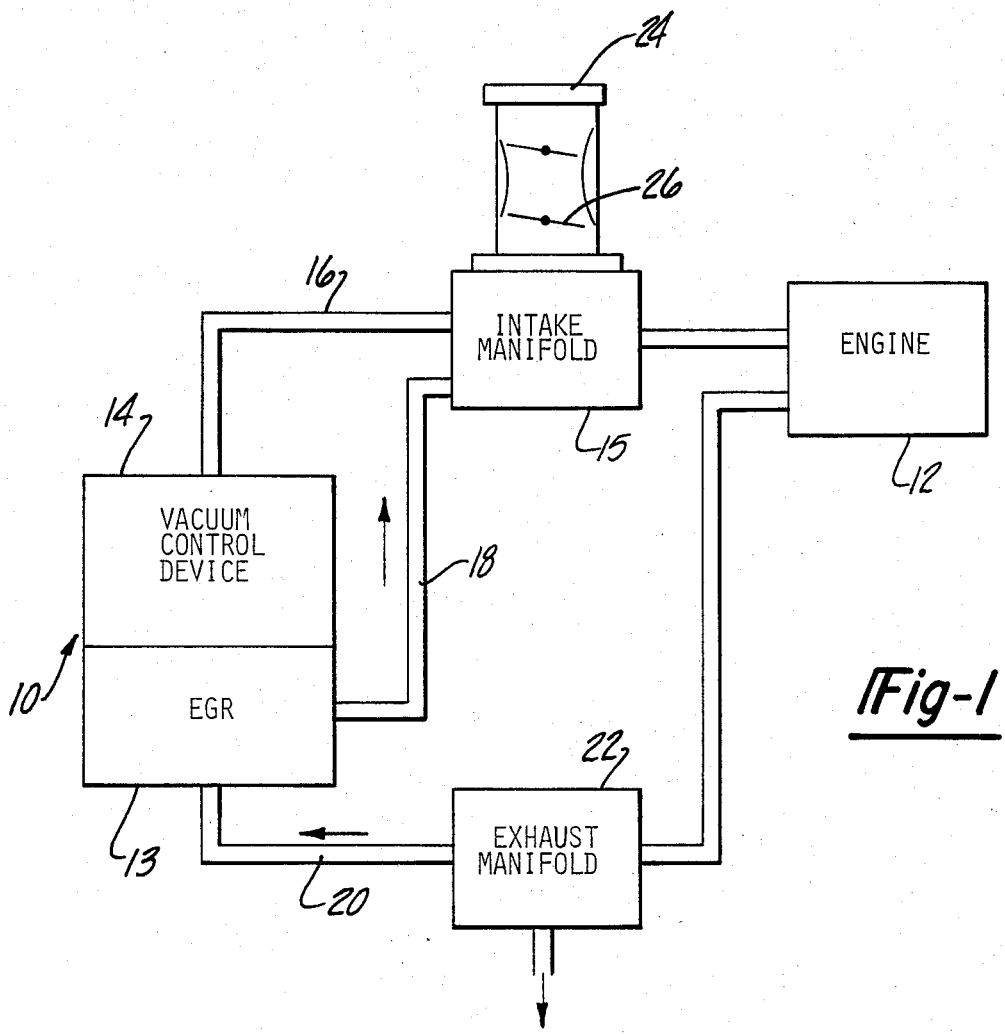
FIG. 1 is a block diagram of an engine having a device according to the present invention incorporated into the fuel system of the engine.

Referring to FIG. 1, a block diagram of a pneumatic or vacuum controlled device 10 according to the present invention is shown in association with the fuel system of engine 12. Specifically, the vacuum controlled device 10 is an exhaust gas recirculation valve (EGR) 13 integrated into a single structure with a device 14 for selectively modifying the vacuum level provided by the intake manifold 15 of the engine. Conduits 16 and 18 connect the vacuum control device 10 to the intake manifold 15 of the engine 12, while conduit 20 connects the device to the exhaust manifold 22 of the engine. The arrows shown in FIG. 1 illustrate the direction of gas flow to and from the vacuum control device 10. A carburetor 24 having a throttle valve 26 is also shown in FIG. 1 to be in association with the intake manifold 15.

As well known in the art, the vacuum level in the intake manifold 15 varies considerably over a normal range of engine operating conditions. Thus, for example, the vacuum in the engine intake manifold 15 will typically become minimal or non-existent whenever the engine 12 is given full throttle (i.e, the throttle valve 26 is wide open). While the intake manifold 15 provides a source of vacuum to the vacuum control device 10 through the conduit 16, the vacuum requirements of the EGR valve 13 generally do not match the vacuum level provided by the intake manifold during certain operating conditions of the engine 12. Thus, at times when it may be advantageous to recirculate a portion of the engine exhaust gases from the exhaust manifold 22 back to the intake manifold 15, the vacuum level in the intake manifold 15 may be insufficient for this purpose. Similarly, there may be times at which the vacuum level provided by the intake manifold 15 is greater than the vacuum level required by the EGR valve 13. One example of such a circumstance would be the time immediately following the starting of the engine where it is generally undesirable to recirculate exhaust gases to the intake manifold via conduits 18 and 20.

Figure 2:
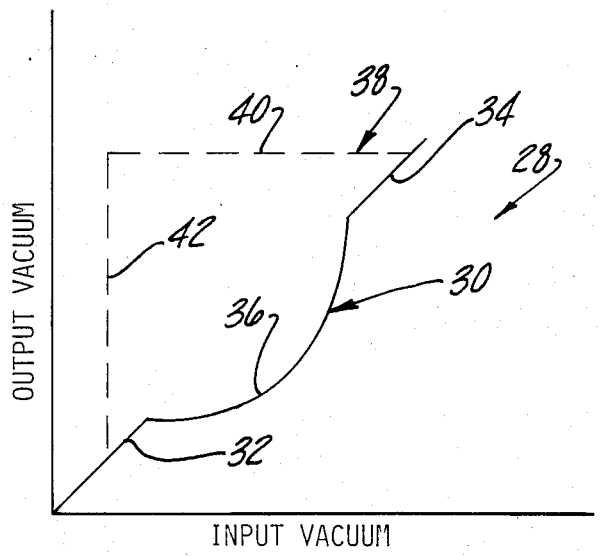
FIG. 2 is a graph showing an example of one possible functional relationship between the input and outlet vacuum levels of a device according to the present invention.

Referring to FIG. 2, a graph 28 is shown which illustrates an example of one possible functional relationship between the input and output vacuum levels of the vacuum control device 14 according to the present invention. The curve 30 of the graph 28 includes a low vacuum linear portion 32, a high vacuum linear portion 34 and a non-linear portion 36. The low vacuum linear portion 32 indicates that during an initial low vacuum level range of operation, the vacuum level output from the vacuum control device 14 will generally be the same as the vacuum level input from the intake manifold 15. However, as the vacuum increases the curve portion 36 indicates that the vacuum control device 14 causes a non-linear reduction from the vacuum level input provided by the intake manifold 15. Subsequently, as the vacuum is further increased the vacuum level output from the vacuum control device 14 again becomes linearly related to the vacuum level input from the intake manifold.

The dash line 38 of the curve 28 shown in FIG. 2 illustrates the relationship between the vacuum level output of the vacuum control device 14 with the vacuum level input during a decrease in the vacuum level provided by the intake manifold 15. Specifically, the horizontal portion 40 of the curve 38 shows that the vacuum control device 14 will maintain the maximum vacuum level reached by the intake manifold 15 at the output of the vacuum control device until a predetermined minimum vacuum level. The curve portion 42 of the curve 38 shows that when the vacuum level of the intake manifold 15 further decreases below the predetermined minimum vacuum level, the vacuum control device will revert to the functional relationship between its vacuum level input and output illustrated by curve 30.

Thus, in the graphical example illustrated, it should be appreciated that over the range of vacuum levels corresponding to the curve portion 36, the vacuum control device 14 will modify the vacuum level in the intake manifold 15 so as to provide a predetermined controlled reduction in this vacuum level, such as during the time immediately following the starting of the engine 12. As the vacuum level of the intake manifold 15 is further increased, the curve portion 34 indicates vacuum level applied to the EGR valve 13 will generally be the same as that currently provided by the intake manifold 15. Then, as the vacuum level of the intake manifold decreases, the curve portion 40 indicates that the vacuum level input to the EGR valve 13 will be the maximum vacuum level reached by the intake manifold 15, as this vacuum level has been maintained by the vacuum control device 14. However, when the vacuum level of the intake manifold 15 decreases below the predetermined minimum vacuum level, the vacuum level input to the EGR valve 13 will quickly drop from the previous maximum vacuum level to the current vacuum level provided by the intake manifold 15. Thus, during certain steady state engine operating conditions the maximum vacuum level to the EGR valve 13 will be maintained even though the opening of the throttle 26 has decreased the vacuum level generated in the intake manifold 15. Accordingly, it should be appreciated by those skilled in the art that the vacuum control device 14 effectively tricks the EGR valve 13 into seeing a reduced vacuum level during an increase in the intake manifold vacuum level, as well as tricks the EGR valve into seeing a maximum vacuum level when the intake manifold vacuum level has significantly decreased.

It should be appreciated by those skilled in the art that the graph shown in FIG. 2 has been used for illustration purposes only, and is not intended to limit the present invention to any particular functional relationship between the inlet and outlet vacuum levels of a vacuum control device according to the present invention. As will be more fully described below, one advantage of the present invention is that the design of the vacuum control device is readily modifiable to provide a variety of functional relationships between its input and output vacuum levels. For example, without limitation, the curve portion 36 of the graph 28 could be replaced by a step-wise function or a plurality of non-linear functions. Similarly, the predetermined minimum vacuum level may be changed for example, to occur during the curve portion 36 of the graph 28.

It should also be noted that while the present invention is described in connection with the intake manifold, the principles of the present invention are also applicable to other sources of vacuum. Thus, for example, an alternate or additional source of vacuum could be provided by a vacuum signal which is derived from the venturi of the carburetor, such as when the engine is given full throttle.

Figure 3:
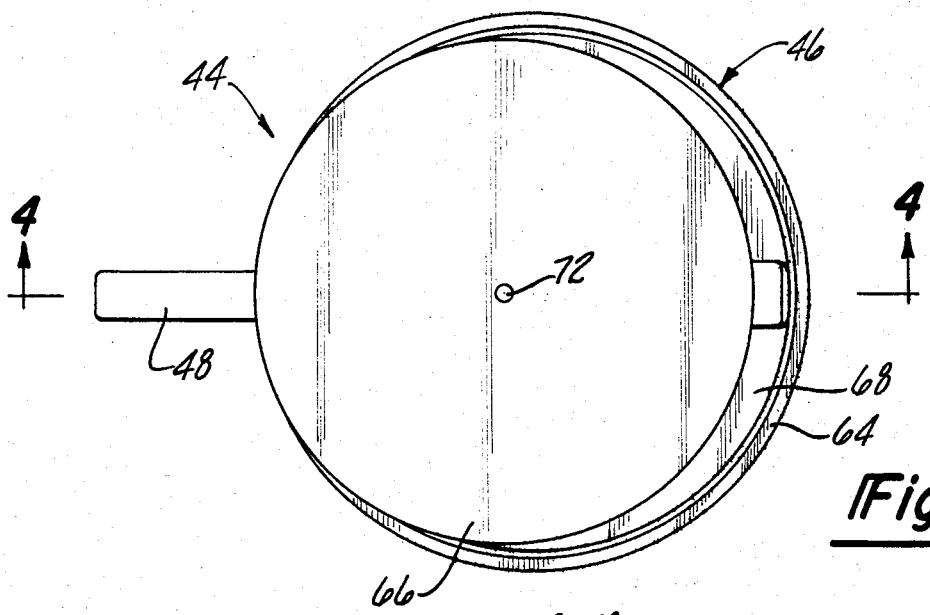
FIG. 3 is a top elevation view of one embodiment of a device according to the present invention.
Figure 4:
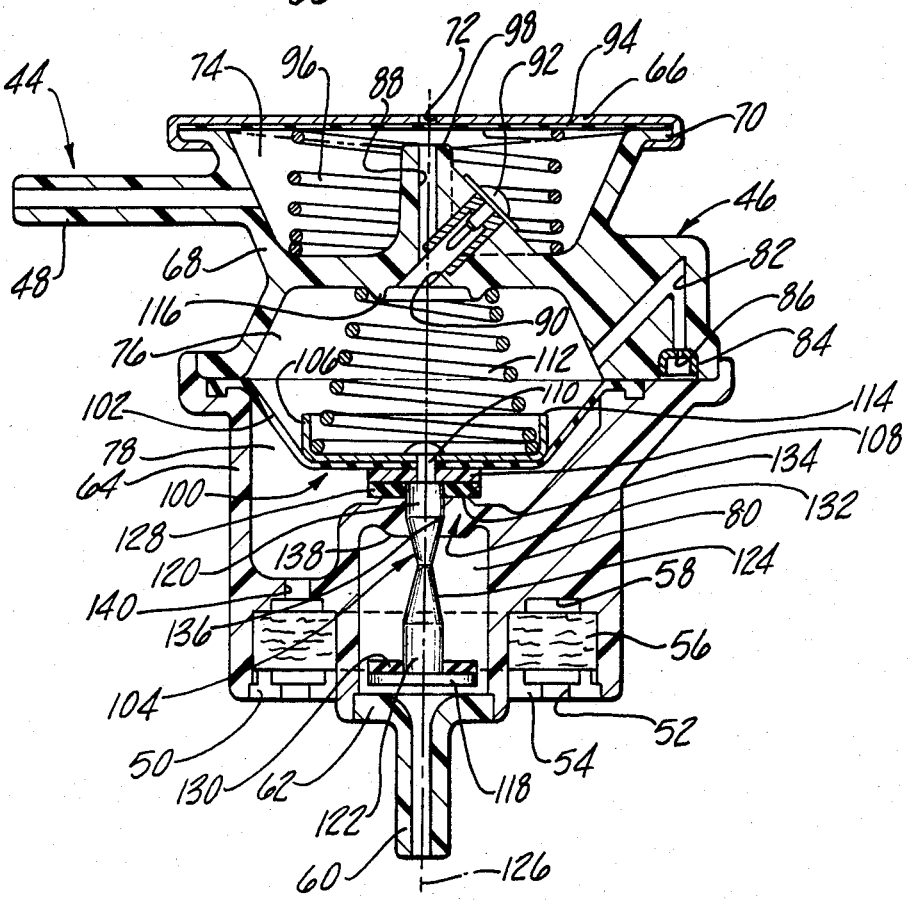
FIG. 4 is a cross-sectional view of the device shown in FIG. 3, taken along lines 4—4 of FIG. 3.

Referring to FIGS. 3 and 4, two views of a vacuum control device 44 according to the present invention is shown. The vacuum control device 44 includes a housing 46 which generally may be made from plastic molded components. The housing 46 is formed with a first inlet port 48 for providing communication between the housing and a variable vacuum source, such as the intake manifold 15 shown in FIG. 1. The housing 46 also includes a second inlet port 50 for providing communication between the housing and the atmosphere. The second inlet port 50 is generally comprised of a plurality of circumferentially spaced openings 52 which are formed in a bottom plate 54 of the housing 46, and an annular filter 56 seated within a cavity 58 of the housing. The housing also includes an outlet port 60 for providing communication between the housing and a vacuum response device, such as an EGR valve. The output port 60 is shown in FIG. 4 to be in the form of a generally tubular member which is outwardly flanged at one end 62. The flanged end 62 of the outlet port 60 may be ultrasonically welded, glued or otherwise suitably secured to a lower section 64 of the housing 46. The housing 46 also includes a top plate which has been secured to an upper section 68 of the housing by having its edge turned and folded under a flange portion 70 of the upper section 68 to the housing 46. The top plate 66 includes an air vent opening 72 which is located generally in the center of the top plate. While the top plate 66 is shown in FIG. 4 to be made out of metal, it should be appreciate by those skilled in the art that other suitable materials may be employed for the top plate.

In the embodiment shown in FIG. 4, the housing 46 is formed to provide a first control chamber 74, a second control chamber 76, an air chamber 78, and a mixing chamber 80. Additionally, the housing 46 is formed with a passageway 82 for providing communication between the second control chamber 76 and the mixing chamber 80. The vacuum control device 44 also includes an orifice element 84 positioned in the passageway 82. The orifice element 84 has a restricted opening 86 for controlling the rate of air flow between the second control chamber 76 and the mixing chamber 80.

The upper section 68 of the housing 46 is formed with two passageways 88 and 90 which connected the first control chamber 74 to the second control chamber 76. As shown in FIG. 4, the passageways 88 and 90 may be conveniently joined at one end thereof to conserve space. The vacuum control device 44 includes a mushroom or flapper type check valve 92 which is mounted in the passageway 90. The check valve 92 is supported in the housing 46 such that it permits air flow from the second chamber 76 to the first chamber 74, but prevents air flow from the first chamber to the second chamber through the passageway 90. The vacuum control device 44 also includes a flexible diaphragm member 94 which is secured to the housing between the flange portion 70 of the housing and the top plate 66. The flexible diaphragm 94 may be made of rubber or any other flexible material suitable for the intended application of the device 44.

The vacuum control device 44 also includes a return spring 96 which is disposed in the control chamber 74 to provide a predetermined controlled resistance to the downward movement of the diaphragm member 94. The return spring 96 may be conveniently comprised of a helical metal coil which has a diameter sufficient to permit the passageways 88 and 90 to be concentrically disposed within the circumference of the coil.

The passageway 88 of the housing 46 also forms a valve seat 98 which is adapted to be closed by the downward movement of the diaphragm member 94 when a predetermined minimum vacuum level is present in the first inlet port 48. This predetermined minimum vacuum level is a function of the force applied by the spring 96 and the flexibility of the diaphragm member 94. Accordingly, it should be appreciated that any suitable predetermined minimum vacuum level may be provided by modifying the diaphragm member material or area, or by changing the characteristics of the spring 96.

While the diaphragm member and the return spring 96 form a first diaphragm valve assembly for the vacuum control device 44, this device also includes a second diaphragm valve assembly which is generally designated by reference numeral 100. The diaphragm valve assembly 100 generally includes a diaphragm member 102 which is secured to the housing 46 generally between the upper section 68 and the lower section 64 of the housing. It should be noted that these two sections of the housing 46 may be ultrasonically welded, glued or otherwise suitably secured together in a leak-tight relationship. The diaphragm valve assembly 100 also includes an elongated reciprocable valve element 104 and a pair of backing plates 106 and 108. The backing plates 106 and 108 are disposed on opposite sides of the diaphragm member 102, and these backing plates are secured to the diaphragm member 102 by means of a fastener 110. The fastener 110 may be a screw or rivet which passes through the backing plates 106 and 108 and is connected to one end of the valve element 104. Alternatively, the fastener 110 may form a part of the valve element 104 which has undergone a cold heading deformation process. The diaphragm valve assembly also includes a return spring 112, which in the embodiment shown is a conically coiled spring. The return spring 112 is disposed in the second control chamber 76 to provide a predetermined controlled resistance to the upward movement of the diaphragm member 102. The backing plate 106 is formed with an upward extending flange portion 114 to provide a seat for the spring 112 at one end thereof. Likewise, the upper section 68 of the housing 46 is formed with a downwardly extending annular bead portion 116 to form a seat for the opposite end of the spring 112. While it is preferred that the backing plates 106 and 108 and the valve element 104 be made from a suitable metal, other materials appropriate to the particular application of the vacuum control device maybe used.

The valve element 104 includes a generally flat base portion 118, an upper cylindrical portion 120, a lower cylindrical portion 122, and a tapered portion 124 interposed between the upper and lower cylindrical portions of the valve element. The valve element 104 is secured to the diaphragm valve assembly 100 such that the center axis of the cylindrical portions 120 and 122 of the valve element coincides with the central axis or axis of reciprocation 126 of the vacuum control device 44. The base portion 118 of the valve element 104 extends from the lower cylindrical portion 122 in a radial direction which is generally perpendicular to the central axis 126. It is important to understand that the present invention is not limited to the particular shape of the valve element 104 shown in FIG. 4. This particular valve element is shown for illustration purposes only, and it should be appreciated that the present invention may be used with a wide variety of valve element configurations.

The diaphragm valve assembly 100 also includes a pair of annular seal elements 128 and 130, which may, for example, be made out of rubber. The upper seal element 128 is glued or otherwise suitably secured to the underside of the backing plate 108, while the lower seal element 130 is secured to the topside of the base portion 118 of the valve element 104.

Figure 5:
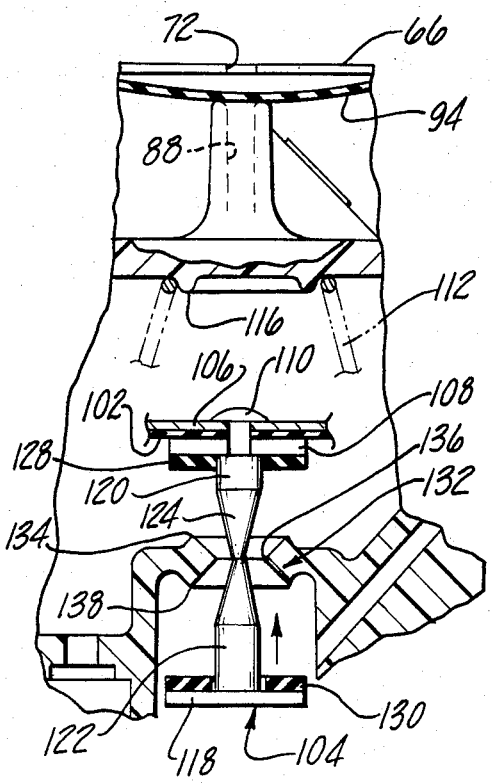
FIGS. 5 and 6 are partial cross-sectional views of the device shown in FIG. 4, with the valve members illustrated in different positions.
Figure 6:
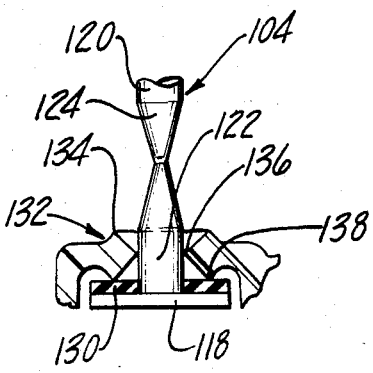

The lower section 64 of the housing 46 is formed to provide a suitable valve seat 132 which will cooperate with the valve element 104 to control the communication between the air chamber 78 and the mixing chamber 80 in a predetermined manner. In the embodiment illustrated in FIG. 4, the valve seat 132 is formed in the shape of an annular diamond which has an upper sealing edge 134, a central sealing edge 136 and a lower sealing edge 138. The upper sealing edge 134 is adapted to prevent any air flow from the air chamber 78 into the mixing chamber 80 when the valve element 104 is in its full downward position shown in FIG. 4. However, as shown in FIG. 5, when the valve element 104 is moved upwardly the central edge 136 is used to control the flow of air from the air chamber 78 to the mixing chamber 80 in cooperation with the shape of the valve element 104. For example, in FIG. 5 a maximum amount of air flow from the air chamber 78 to the mixing chamber 80 will be provided since the apex of the tapered portion 124 of the valve element is aligned with the central edge 136 of the valve seat 132. Similarly, when one of the cylindrical portions 120, 122 are radially aligned with the central edge 136 of the valve seat 132 little or no air flow will be provided to the mixing chamber 80 from the air chamber 78. In like manner to that shown in FIG. 4, FIG. 6 shows that the lower edge 138 of the valve seat 132 will prevent fluid communication between the air chamber 78 and the mixing chamber 80 when the valve element 104 has moved to its full upward position. Thus, it should be appreciated that when the valve element 104 is in its full downward position, the seal element 128 closes the valve seat 132. Similarly, when the valve element 104 is in its full upward position, the seal member 130 closes the valve seat 132.

It should be understood that the present invention is not limited to the particular housing shape shown in FIG. 4, and that this housing is only intended to illustrate the principles of the present invention. Thus, for example, the housing could be configured to eliminate the air chamber 78 and the filter 56 in the appropriate application, with these elements being replaced by an opening formed in the lower section of the housing. It should also be noted that the housing 46 is formed with a passageway 140 formed in the lower section 64 to provide communication between the cavity 58 and the air chamber 78.

With respect to the operation of the vacuum control device 44, an initial minimal vacuum level present in the first inlet port 48 will cause air to flow from the outlet port 60 to the inlet port 48. This air will travel through the mixing chamber 80, the passageway 82, the control chamber 76, the passageway 88, and the control chamber 74. When the vacuum level in the first inlet port 48 increases to a predetermined minimum vacuum level, the diaphragm member 94 will move downwardly against the force of the spring 96 and close the passageway 88. However, as the vacuum level in the first inlet port 48 further increases, air will be permitted to flow from the control chamber 76 through the check valve 92 to the control chamber 74. Thus, it should be appreciated that the first diaphragm valve assembly and the check valve 92 permit an increasing vacuum level at the first inlet port 48 to be communicated to the control chamber 76 in the housing 46. This vacuum level is then communicated from the control chamber 76 through the passageway 82 and the mixing chamber 80 to the outlet port 60 of the device 44.

The presence of a vacuum in the control chamber 76 will apply a force upon the diaphragm member 102 of the diaphragm valve assembly 100 which will gradually move the valve element 104 upward from its full downward position shown in FIG. 4 against the resistive force of the spring 112. At some predeterminably defined vacuum level, the valve element 104 will move sufficiently upward that air will begin to flow between the valve element 104 and the valve seat 132, whereby air will be introduced from the atmosphere through the filter 58 and air chamber 78 into the mixing chamber 80. The introduction of air into the mixing chamber 80 from the air chamber 78 will have the effect of reducing the vacuum level present in the outlet port 60 in accordance with the cooperative shapes of the valve element 104 in the valve seat 132. While this reduction in the vacuum level will also be communicated to the control chamber 76 from the mixing chamber 80 through the passageway 82, the restricted opening 86 in the orifice 84 will control the air exchange rate so as to dampen any fluttering of the diaphragm valve assembly 100 which could otherwise occur.

At some further increased vacuum level in the first inlet port 48, the valve element 104 will be forced to its full upward position shown in FIG. 6 due to the force of the vacuum present in the control chamber 76. This will prevent any further air flow from the air chamber 78 to the mixing chamber 80, and therefore the maximum vacuum level present in the inlet port 48 will be communicated to the outlet port 60.

At a subsequent time when the vacuum level present in the first inlet port 48 decreases, the vacuum control device 44 will act to maintain the maximum vacuum level previously achieved in the inlet port 48. This function of the vacuum control device 44 is provided by the combination of the first diaphragm valve assembly (diaphragm member 94 and spring 96) and the check valve 92, which prevent a decreasing vacuum level in the inlet port 48 from being communicated to the control chamber 76 until the predetermined minimum vacuum level is reached in the inlet port 48. When this predetermined minimum vacuum level is reached, the diaphragm member 94 will move upwardly under the force of the return spring 96 and open the valve seat 98. This will provide a rapid exchange of air between the control chambers 74 and 76 through the passageway 88, and a more delayed exchange of air between the control chamber 76 and the mixing chamber 80 through the passageway 82. Accordingly, it should be appreciated that the vacuum level in the outlet port 60 will become quickly equalized with the current vacuum level in the inlet port 48.

Thus, it will be seen that the vacuum control device 44 includes valve means for controlling the communication between the first inlet port 48 and the outlet port 60 and between the second inlet port 50 and the outlet port 60, such that the vacuum level in the outlet port is a predeterminable function of the vacuum level in the first inlet port during an increase in the vacuum level in the first inlet port from a vacuum level below the predetermined minimum vacuum level, and the vacuum level in the outlet port is maintained during a decrease in the vacuum level in the first inlet port above the predetermined minimum vacuum level. The predetermined controlled communication between the second inlet port 50 and the outlet port 60 is a function of the respective shapes of the valve element 104 and the valve seat 132, as well as the flexibility of the diaphragm member 102 and/or area thereof and the force of the return spring 112. Accordingly, a variety of linear and/or non-linear functions may be provided by suitably varying the various shapes of the valve element 104 and the valve seat 132, and the force applied by the spring 112. The predetermined minimum vacuum level may also be suitably modified in combination with modifications to the diaphragm valve assembly 100 to provide further functional relationships between the vacuum levels in the inlet port 48 and the outlet port 60. It is important to note that even though the design of a vacuum control device in accordance with the present invention is readily adaptable to a wide variety of modifications, the number of components employed in the device, as well as the number of assembly steps, are relatively few.

Figure 7:
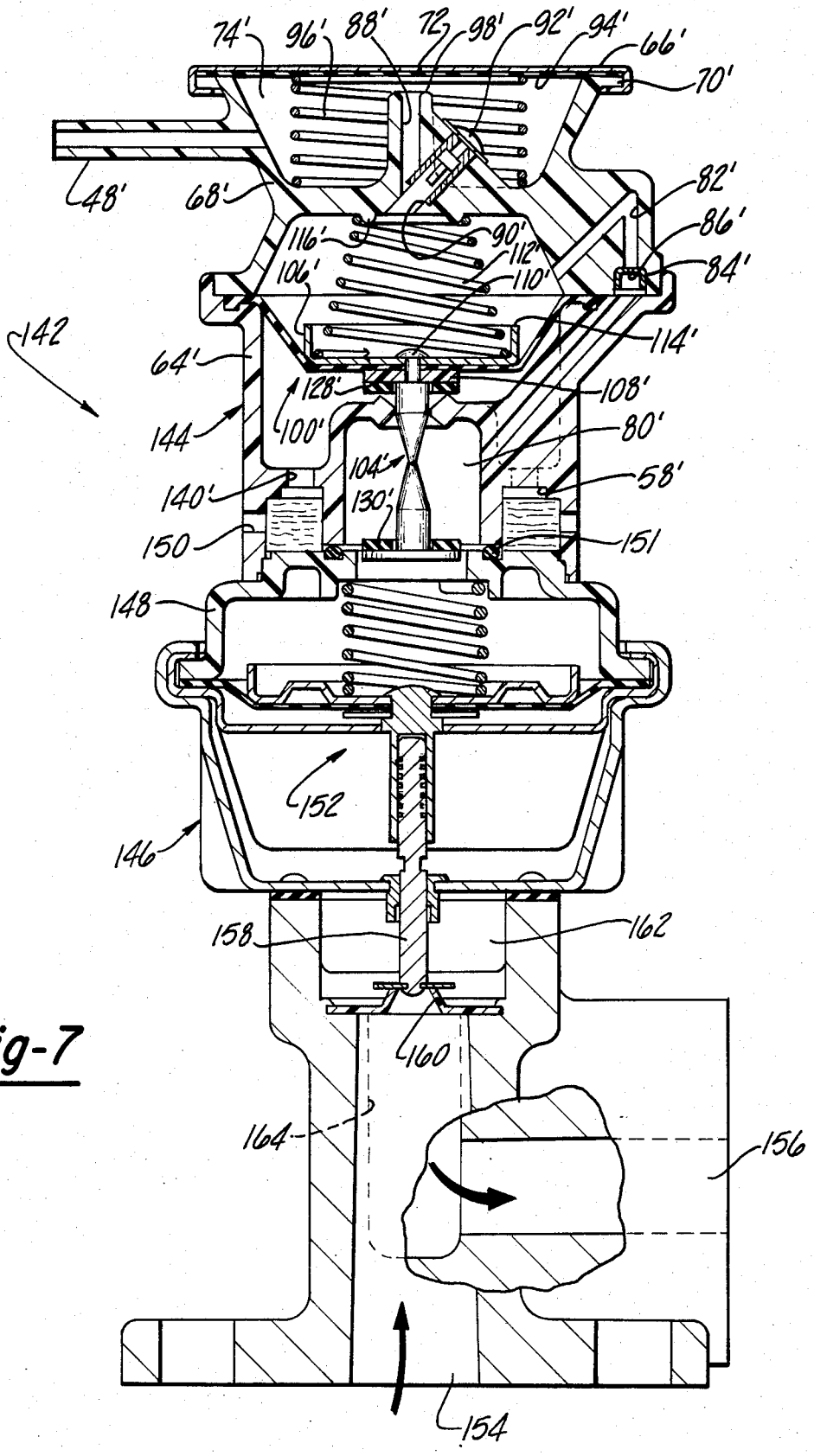
FIG. 7 is a cross-sectional view of a second embodiment of a device according to the present invention.

Referring now to FIG. 7, another embodiment of a vacuum control device 142 according to the present invention is shown. The vacuum control device 142 is generally comprised of the combination of a vacuum control device 144 of the type shown in FIG. 4 and an EGR valve 146 into a single integrated structure. Due to the similarity between the vacuum control device 144 and the vacuum control device shown in FIG. 4, corresponding components will be shown with their reference numerals primed in FIG. 7.

It should be noted that the vacuum control device 142 includes an interfacing plate 148 which functions both as a bottom plate for the device 144 and a top plate for the EGR valve 146. In this embodiment, the second inlet port is now comprised of a plurality of circumferentially spaced openings 150 which are formed to extend radially in the lower section 64' of the housing for the device 144. Additionally, an O-ring element 151 is disposed between the interfacing plate 148 and the lower section 64' to prevent any exchange of air between the second inlet port 50' and the mixing chamber 80', except as may be provided through the diaphragm valve assembly 100'. The lower section 64' of the device 144 may be ultrasonically welded or otherwise suitably secured to the interfacing plate 148.

The EGR valve 146 generally includes a diaphragm valve assembly 152 for controlling the communication between an inlet port 154 and an outlet port 156. The inlet port 154 is used to provide communication between the EGR valve 146 and the exhaust manifold of the engine, while the outlet port 156 is used to provide communication between the EGR valve and the intake manifold of the engine. The diaphragm valve assembly 152 is responsive to the vacuum level in the mixing chamber 80' to cause an upward movement of the valve element 158 from its closed position shown in FIG. 7. When the upward movement of the valve element 158 opens the valve seat 160, exhaust gases from the inlet port 154 will pass through the valve seat 160 into a chamber 162 of the EGR valve. From the chamber 162 the exhaust gases will pass down through a passageway 164 which is disposed behind the inlet port 152 as shown in FIG. 7, and out to the outlet port 156.

The various embodiments which have been set forth above were for the purpose of illustration and were not intended to limit the invention. It will be appreciated by those skilled in the art that various changes and modifications may be made to these embodiments described in this specification without departing from the spirit and scope of the invention as defined by the appended claims.

What is claimed is:

1. An exhaust gas recirculation valve assembly for an internal combustion engine, comprising:

a housing;

first inlet means for providing communication between said housing and the intake manifold of said engine;

second inlet means for providing communication between said housing and the atmosphere;

third inlet means for providing communication between said housing and the exhaust manifold of said engine;

outlet means for providing communication between said housing and said intake manifold of said engine;

first valve means contained in said housing for controlling the communication between said first inlet means and a mixing chamber formed in said housing and between said second inlet means and said mixing chamber, such that the vacuum level in said mixing chamber includes a first range in which the vacuum level in said mixing chamber is a linear function of an increasing vacuum level in said first inlet means and a second range in which the vacuum level in said mixing chamber is a non-linear function of an increasing vacuum level in said first inlet means by permitting a controlled communication with both said first and second inlet means and said mixing chamber, and the vacuum level in said mixing chamber is maintained during a decrease in the vacuum level in said first inlet means above said predeterminable vacuum level; and second valve means contained in said housing for controlling the communication between said third inlet means and said outlet means in response to the vacuum level in said mixing chamber.

2. A vacuum control device, comprising:
a housing;
a first inlet port formed in said housing for providing communication between said housing and a variable vacuum source;
a second inlet port formed in said housing for providing communication between said housing and the atmosphere;
an outlet port formed in said housing for providing communication between said housing and a vacuum responsive device;
first, second and third chambers formed in said housing, said first control chamber being in communication with said first inlet port, and said third chamber being in communication with said output port;
a first passageway formed in said housing for providing communication between said second control chamber and said third chamber;
a first diaphragm valve assembly supported in said housing for closing a second passageway formed in said housing between said first and second chambers in response to a predeterminable vacuum level at said first inlet port;
a check valve supported in said housing such that it permits air flow from said second chamber to said first chamber and prevents air flow from said first chamber to said second chamber while said second passageway is closed;
a second diaphragm valve assembly supported in said housing which is responsive to the vacuum level in said second chamber for permitting a predeterminably controlled introduction of air from said second inlet port to said third chamber over a predeterminable vacuum level range.

3. A device for selectively modifying a vacuum level provided by a variable vacuum source, comprising:
a housing;
first inlet means for providing communication between said housing and said vacuum source;
second inlet means for providing communication between said housing and the atmosphere;
outlet means for providing communication between said housing and a vacuum responsive device; and
valve means contained in said housing for controlling the communication between said first inlet means and said outlet means and between said second inlet means and said outlet means, such that the vacuum level in said outlet means includes a first range in which the vacuum level in said outlet means is a linear function of an increasing vacuum level in said first inlet means and a second range in which the vacuum level in said outlet means is a non-linear function of an increasing vacuum level in said first inlet means by permitting a controlled communication with both said first and second inlet means and said outlet means, and the vacuum level in said outlet means is maintained during a decrease in the vacuum level in said first inlet means above said predeterminable vacuum level.

4. The device according to claim 3, wherein said predeterminable function provided by said valve means is linear above said predeterminable vacuum level range.

5. A device for selectively modifying a vacuum level provided by a variable vacuum source, comprising:
a housing;
first inlet means for providing communication between said housing and said vacuum source;
second inlet means for providing communication between said housing and the atmosphere;
outlet means for providing communication between said housing and a vacuum responsive device;
first valve means contained in said housing for controlling the communication between said first inlet means and a control chamber within said housing, such that the maximum vacuum level reached by said vacuum source beyond a predeterminable vacuum level is maintained in said control chamber;
passage means formed in said housing for providing communication between said control chamber and said outlet means; and
second valve means contained in said housing and responsive to the vacuum level in said control chamber for permitting a predeterminable controlled communication between said second inlet means and said outlet means over a predeterminable vacuum level range.

6. The device according to claim 5, wherein said second valve means includes a reciprocable valve assembly which is responsive to the vacuum level in said control chamber to permit a controlled introduction of air to said outlet means to reduce the vacuum level in said outlet means over at least a portion of said predeterminable range.

7. The device according to claim 6, wherein said first valve means includes first spring means for defining said predeterminable vacuum level, and said second valve means includes second spring means for providing a controlled resistance to the force applied to said reciprocable valve assembly by the vacuum in said control chamber.

8. A device for selectively modifying a vacuum level provided by a variable vacuum source, comprising:
a housing;
first inlet means for providing communication between said housing and said vacuum source;
second inlet means for providing communication between said housing and the atmosphere;
outlet means for providing communication between said housing and a vacuum responsive device;
first valve means contained in said housing for controlling the communication between said first inlet means and a control chamber within said housing, such that the maximum vacuum level reached by said vacuum source beyond a predeterminable vacuum level is maintained in said control chamber;
passage means formed in said housing for providing communication between said control chamber and said outlet means; and
second valve means contained in said housing and responsive to the vacuum level in said control chamber for controlling the communication between said second inlet means and said outlet means such that communication is prevented above and below a predetermined vacuum level range and communication is permitted in accordance with a predeterminable function over said predeterminable vacuum level range.

9. The device according to claim 8, wherein said second valve means includes a reciprocable valve element which is formed with a base portion which cooperates with a valve seat formed in said housing for preventing communication between said second inlet means and said outlet means at vacuum levels in said control chamber above said predeterminable vacuum level range.

10. The device according to claim 9, wherein said valve seat is formed to have a generally annular diamond shape.

11. The device according to claim 9, wherein said second valve means is also provided with annular sealing elements associated with said reciprocable valve element.

12. A device for selectively modifying a vacuum level provided by a variable vacuum source, comprising:

a housing;

first inlet means for providing communication between said housing and said vacuum source;

second inlet means for providing communication between said housing and the atmosphere;

outlet means for providing communication between a mixing chamber of said housing and a vacuum responsive device;

first valve means associated with said housing for permitting an increasing vacuum level at said first inlet means to be communicated to a control chamber in said housing and preventing a decreasing vacuum level at said first inlet means from being communicated to said control chamber until a predeterminable vacuum level at said first inlet means is reached;

second valve means associated with said housing for permitting a predeterminable controlled communication of the atmosphere at said second inlet means to said mixing chamber in said housing in response to the vacuum level in said control chamber; and passage means formed in said housing for providing communication between said control chamber and said mixing chamber.

13. The device according to claim 12, wherein said passage means includes orifice means for controlling the rate of air flow between said control chamber and said mixing chamber.

14. The device according to claim 12, wherein said second valve means includes a reciprocable valve element whose shape defines said predeterminable controlled communication of the atmosphere to said mixing chamber of said housing.

15. The device according to claim 14, wherein said first valve means includes check valve means for permitting an increasing vacuum level at said first inlet means to be communicated to said control chamber in said housing and preventing a decreasing vacuum level at said first inlet means from being communicated to said control chamber, and diaphragm valve means for permitting communication between said first inlet means and said control chamber until the vacuum level at said first inlet means reaches said predetermined vacuum level.

16. The device according to claim 15, wherein said second inlet means includes an annular filter and a plurality of circumferentially spaced openings formed in said housing.

17. The device according to claim 15, wherein said control chamber is defined in part by a diaphragm assembly of said second valve means.

18. The device according to claim 17, wherein said reciprocable valve element of said second valve means is secured to said diaphragm assembly, and said second valve means includes spring means for providing a predeterminable controlled resistance to the movement of said reciprocable valve element which is in opposition to force applied to said diaphragm assembly by the vacuum in said control chamber.

* * * * *

UNITED STATES PATENT AND TRADEMARK OFFICE

CERTIFICATE OF CORRECTION

PATENT NO. : 4,633,845

DATED : January 6, 1987

INVENTOR(S) : Frank M. Seleno

It is certified that error appears in the above-identified patent and that said Letters Patent is hereby corrected as shown below:

Column 5, Line 46, "output" should be --outlet--.
Column 5, Line 58, "appreciate" should be --appreciated--.
Column 6, Line 4, "connected" should be --connect--.
Column 6, Line 18, "of" should be --out of--.
Column 7, Line 10, "maybe" should be --may be--.
Column 11, Line 28, "closed;" should be --closed; and--.

Signed and Sealed this

Eighteenth Day of August, 1987

*Attest:*

DONALD J. QUIGG

*Attesting Officer*

*Commissioner of Patents and Trademarks*